US006481328B1

(12) United States Patent
Hallqvist

(10) Patent No.: US 6,481,328 B1
(45) **Date of Patent: *Nov. 19, 2002**

(54) METHOD AND DEVICE FOR HANDLING PROPELLANT CHARGES

(75) Inventor: Sten Hallqvist, Vingåker (SE)

(73) Assignee: Bofors Defense AB, Karlskoga (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/477,676

(22) Filed: Jan. 5, 2000

Related U.S. Application Data

(63) Continuation-in-part of application No. 09/068,530, filed as application No. PCT/SE97/02008 on Dec. 1, 1997, now Pat. No. 6,026,729.

(51) Int. Cl.[7] ..... F41A 9/42
(52) U.S. Cl. ..... 89/46; 89/47
(58) Field of Search ..... 89/45, 46, 47, 89/33.05

(56) References Cited

U.S. PATENT DOCUMENTS

| | | | | | |
|---|---|---|---|---|---|
| 4,438,677 | A | * | 3/1984 | Spotzl et al. | 89/47 |
| 4,457,209 | A | * | 7/1984 | Scheurich et al. | 89/45 |
| 4,648,305 | A | * | 3/1987 | Elspass | 89/45 |
| 4,819,518 | A | | 4/1989 | Pahnke | 89/46 |
| 5,111,730 | A | * | 5/1992 | Grabner | 89/45 |
| 5,111,731 | A | | 5/1992 | Grabner | 89/46 |
| 5,261,310 | A | * | 11/1993 | Sullivan et al. | 89/46 |
| 5,267,503 | A | | 12/1993 | Grabner | 89/46 |
| 5,289,754 | A | | 3/1994 | Elspass | 89/46 |
| 5,337,649 | A | * | 8/1994 | Franzen et al. | 89/33.04 |
| 5,526,730 | A | * | 6/1996 | Zangrando | 89/34 |
| 5,728,966 | A | | 3/1998 | Bobinger et al. | 89/46 |
| 5,844,163 | A | * | 12/1998 | Lindskog | 89/46 |

FOREIGN PATENT DOCUMENTS

| | | | | |
|---|---|---|---|---|
| DE | 2531936 | * | 3/1977 | 89/46 |
| DE | 3642920 | | 6/1988 | 89/46 |
| DE | 3903671 | | 8/1990 | |
| EP | 360776 | * | 3/1990 | 89/47 |
| EP | 569342 | * | 11/1993 | 89/47 |
| GB | 1251176 | | 10/1971 | |
| GB | 1490112 | | 10/1977 | |
| JP | 3294793 | | 12/1991 | 89/47 |

OTHER PUBLICATIONS

Pan, K.C., Applications of Robotics and Artificial Intelligence to Armament Army Research, Development and Acquisition Magazine, 10/83, pp. 15–17, 89/45.

* cited by examiner

*Primary Examiner*—Stephen M. Johnson
(74) *Attorney, Agent, or Firm*—Connolly Bove Lodge & Hutz LLP

(57) ABSTRACT

A device for assembling complete propellant charges from a plurality of modular propellant charges. A plurality of magazine tubes each receives a plurality of modular charges. Each magazine tube has an outfeed aperture. A plurality of ejectors eject the modular charges from the magazine tubes. At least one retrieval tube receives the modular charges from the magazine tubes. A manipulator alters a position of the at least one retrieval tube adjacent any of the magazine tubes for retrieving the modular charges from among the magazine tubes. The manipulator also alters the position of the at least one retrieval tube to be adjacent a loading mechanism of an artillery gun.

28 Claims, 12 Drawing Sheets

METHOD AND DEVICE FOR HANDLING PROPELLANT CHARGES

This application is a continuation-in-part of U.S. patent application Ser. No. 09/068,530 filed on Sep. 11, 1998, now U.S. Pat. No. 6,026,729, which is a 371 of PCT/SE97/02008 filed Dec. 1, 1997.

FIELD OF THE INVENTION

The present invention relates to a method and a device for stowing and handling modular-type propellant charges in artillery guns with fully or semi-automatic loading systems.

BACKGROUND OF THE INVENTION

It is already possible using artillery locating radar and other surveillance systems, for example, to determine rapidly and with high precision the location of an artillery gun that has opened fire. There is thus a good opportunity for an enemy to open effective counter-battery fire. The artillery has therefore more or less been forced to depart from its previously fairly stationary tactics in favor of significantly more mobile tactics involving rapid engagements in the form of short intensive fires followed by immediate redeployment to a pre-determined deployment site at a sufficiently safe distance from the previous one. These new tactics have resulted in an increased need for every gun to be self-propelled and capable of carrying at least a primary requirement of ammunition.

One must also assume that coming generations of artillery will use modular-type propellant charges that is, propellant charges consisting of a number of modular charges of different sizes, such as length and, to a certain extent, diameter, and of different charge strength with primarily rigid combustible outer casings, and that are combinable in various ways to provide the desired muzzle velocities. At present, this system of modular charges is called M(A)CS, that is, Modular (Artillery) Charge System. Moreover, the next generation of artillery guns is expected to be equipped with armored protection against battlefield fragments to an even greater extent than is normal today. Next generation loading systems will be required to operate very rapidly and be capable of stowing large quantities of propellant charges and of handling all the different types of propellant charges in the M(A)CS. The propellant charges must also be stowable in the least possible space. In addition, loading systems shall be robust and durable. Also, the propellant charge magazine shall be replenishable in a very short time, preferably from a vehicle equipped with an automatic resupply unit.

SUMMARY OF THE INVENTION

A purpose of the present invention is to offer a propellant charge handling system that meets the above stated requirements.

The present invention is based, at least in part, on the use of a very compact stowage space in which the modular charges are stowed linearly in a number of magazine tubes arranged parallel to each other. Each magazine tube contains a single type of modular charges. Each such magazine tube terminates in a common endplane, while the opposite end of each magazine tube is accessible for an ejector provisionally built into the tube. Even ejectors operated by compressed air ought to be usable.

In combination with this magazine, a manipulator is used that can be described as an industrial robot with limited operating motion arranged to maneuver a retrieval tube between the outfeed apertures of the magazine tubes. The retrieval tube is thus aligned with a magazine tube after which a desired number of modular charges are transferred to the retrieval tube. This arrangement can thus retrieve modular charges from a number of different magazine tubes and, thereby, assemble a complete propellant charge of the desired charge strength before it is maneuvered to an outer end position aligned with the loading pendulum used to load the artillery gun in question and to which the complete charge is transferred by, for example, an ejector built into the retrieval tube. The latter can also be used to determine the number of modular charges to be retrieved from a specific magazine tube.

One variant of the present invention can include two identically designed compact magazines and arrange a retrieval tube in a space between them. This arrangement enables this variant to retrieve modular charges from both its ends. In this variant, the retrieval tube should also be usable for transferring modular charges to the loading pendulum, or be usable itself as a loading pendulum for loading the gun. However, in this variant, the ejector must be specially designed so that it is not in the way when replenishing with modular charges via the rear aperture of the retrieval tube.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The method and device according to the present invention shall now be described in further detail with reference to the appended figures in which.

DETAILED DESCRIPTION OF THE INVENTION

Figure 1:
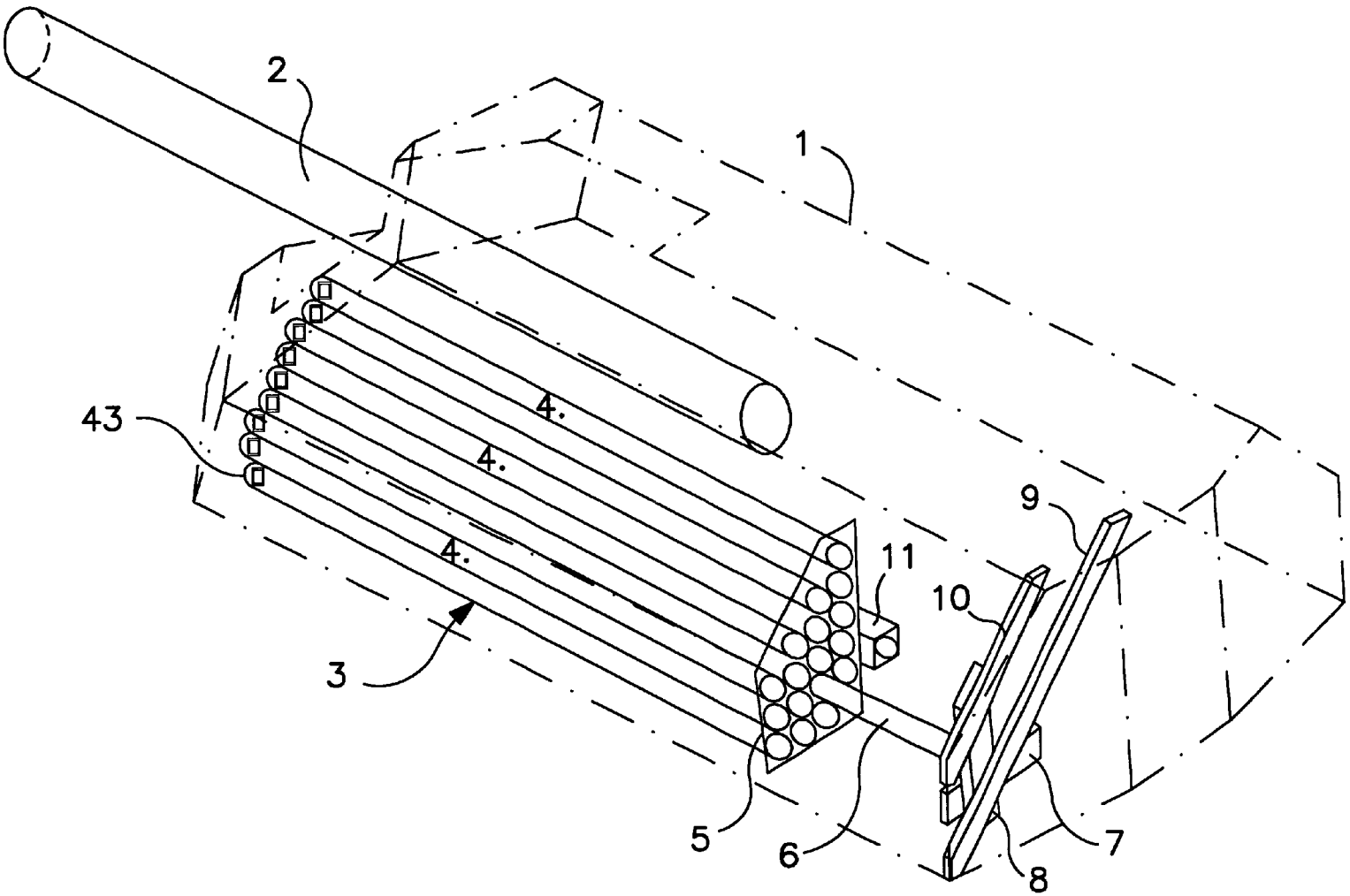
FIG. 1 shows a perspective partial cut-away view of an artillery gun mounted in an armored turret.
Figure 2:
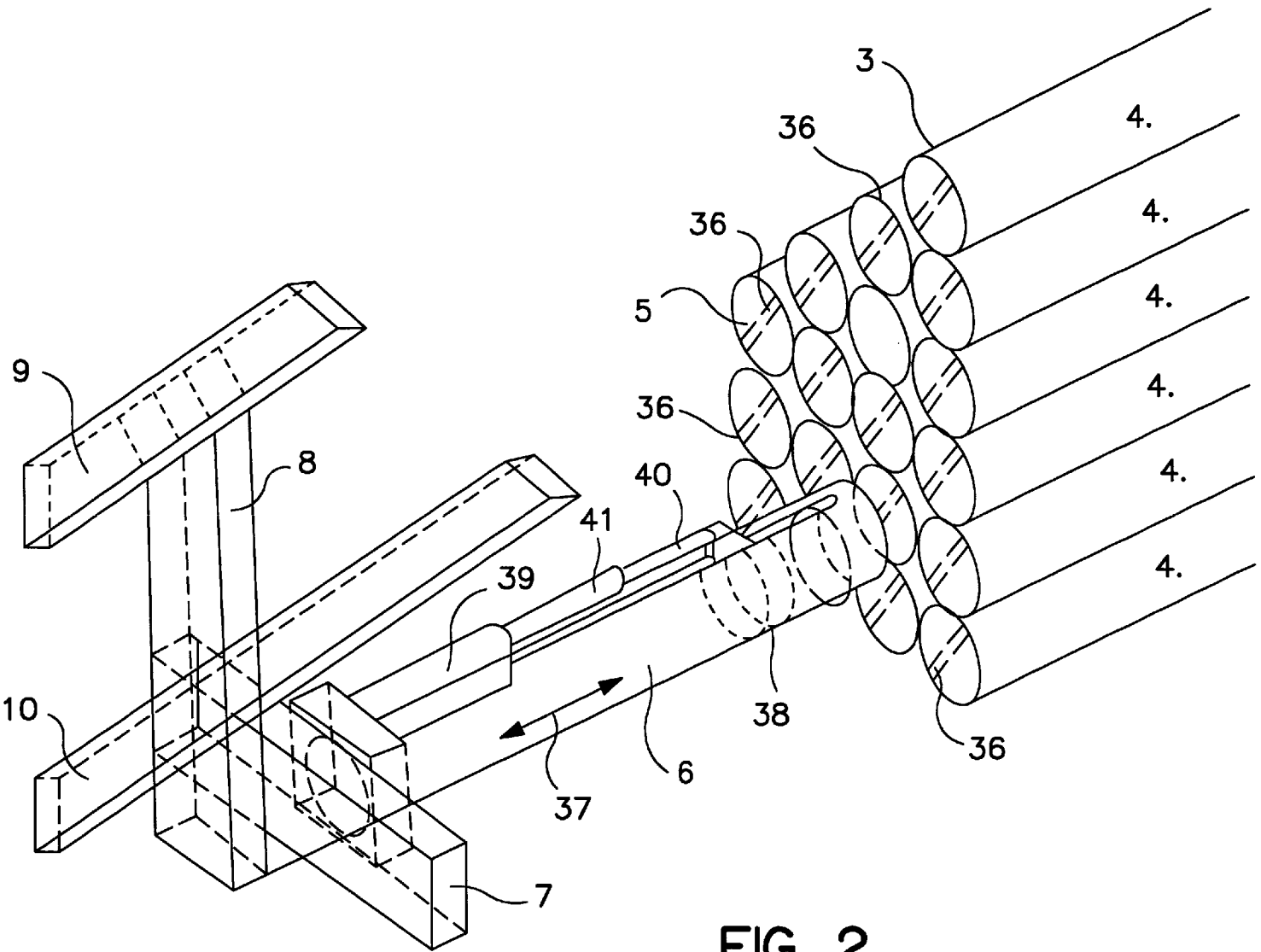
FIG. 2 shows a perspective view of a subassembly from the artillery gun shown in FIG. 1 to a larger scale.

Parts shown on more than one figure, primarily FIGS. 1 and 2 and, partially, 4, have the same designation, irrespective of scale.

Figure 4:
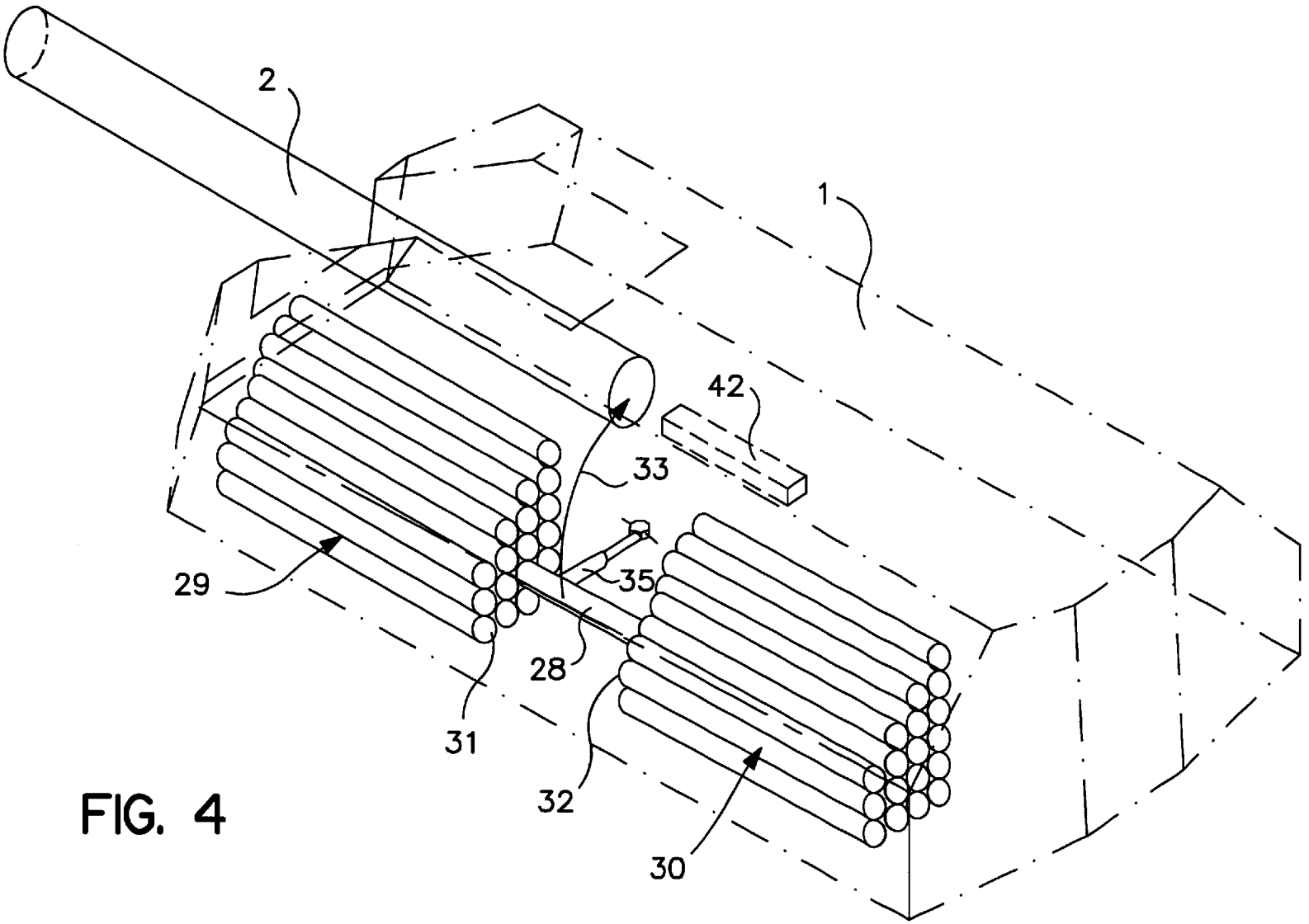
FIG. 4 shows a perspective partial cut-away view similar to the view shown in FIG. 1 of an embodiment of the present invention with a propellant magazine divided into two sections.

FIGS. 1 and 4 show the outer contours of an artillery gun 2 mounted in an armored turret 1. All parts relating to the mounting of the gun, loading trays, rammer, and the complete projectile handling system have been excluded from the figures for the sake of clarity.

Figure 7:
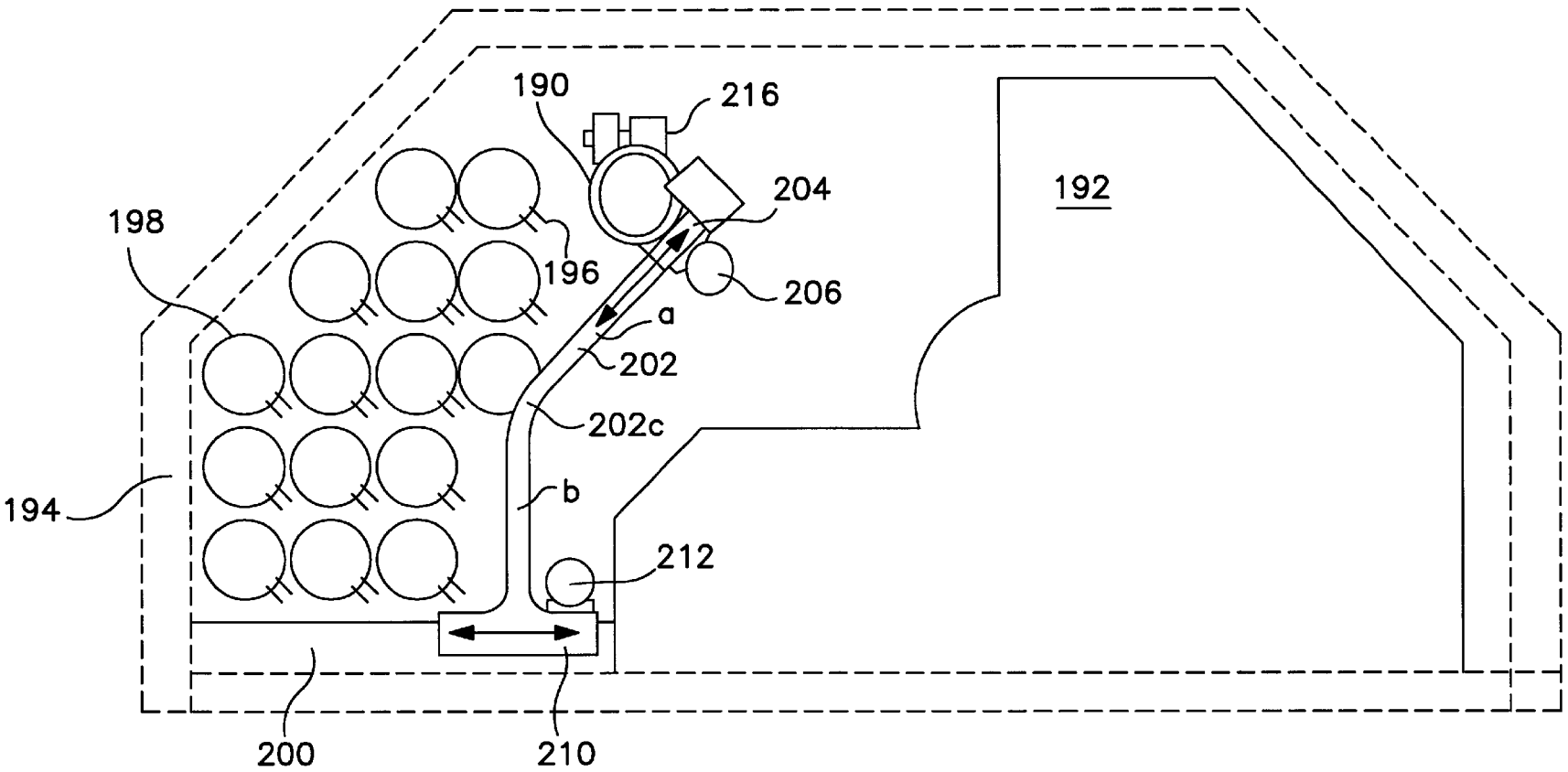
FIG. 7 shows a cross-sectional view of an embodiment of a retrieval mechanism and charge magazines according to the present invent ion.

As illustrated in FIGS. 1, 4, and 7, the armored turret may have a roof that includes sloping portions. Such a design may help to maximize protection of the charges, shells, and mechanisms within the turret. Also, it may be desirable with such a design to arrange the magazine tubes in a sloping fashion as shown in the Figures.

In the armored turret 1 there is a compact modular charge magazine 3 consisting of a plurality of magazine tubes. The embodiment illustrated in FIG. 1 includes eighteen magazine tubes. The magazine tubes may be arranged on top of and beside each other.

Figure 3:
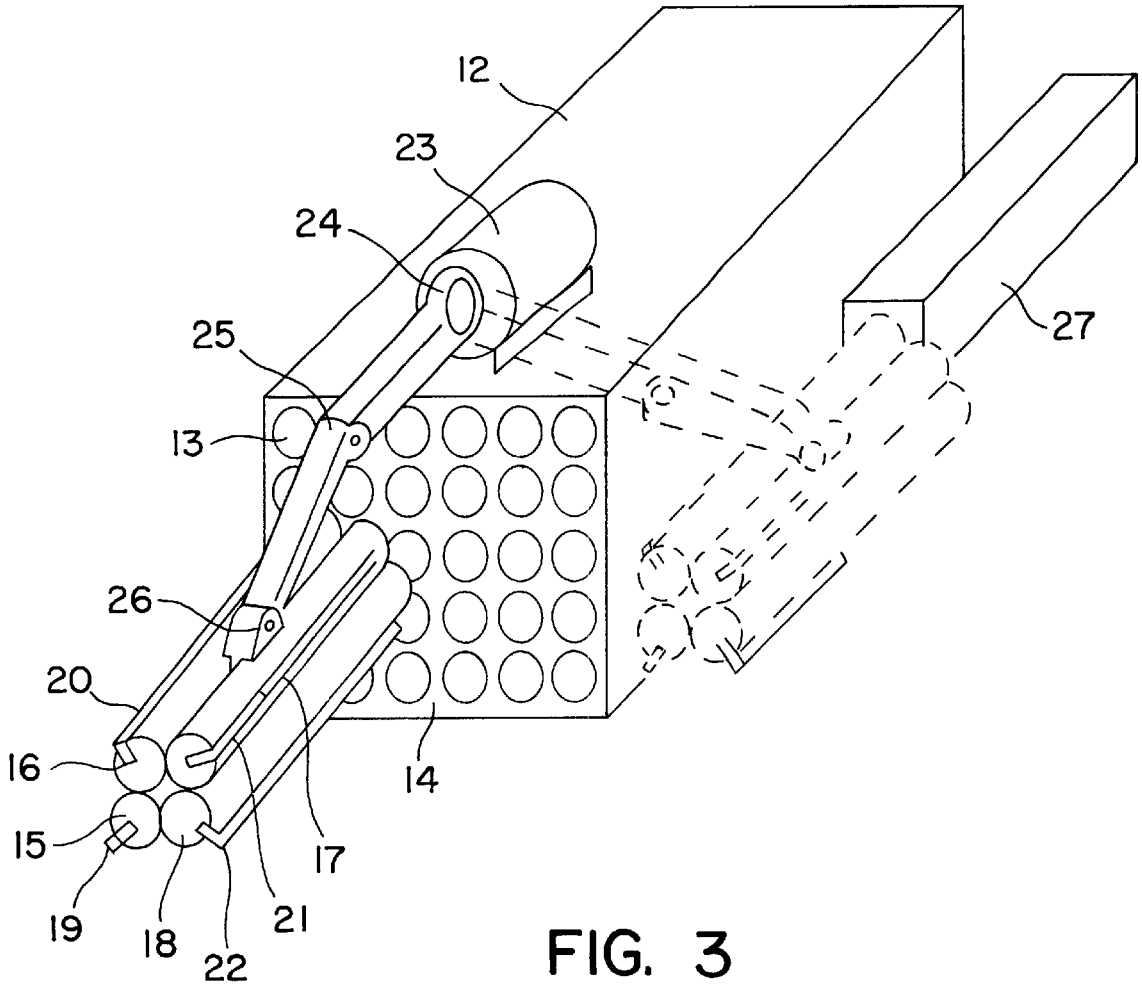
FIG. 3 shows a perspective view of another embodiment of a device according to the present invention.

All the magazine tubes terminate in one and the same vertical endplane 5. Each of the magazine tubes 4 has its outfeed aperture in this endplane. Each such outfeed aperture may, if so desired, be equipped with an openable and closable protective cap or catch. FIG. 3 illustrates one embodiment of a catch.

Figure 12A:
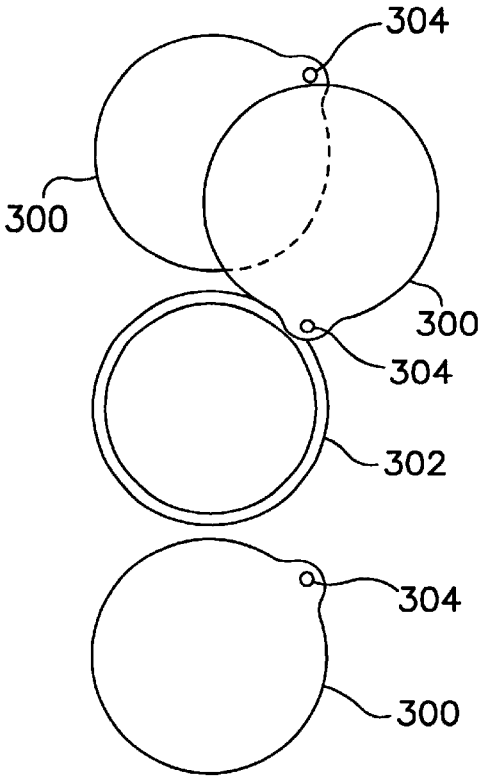
FIGS. 12*a* and 12*b* show, respectively, an end view and a side view of magazine tubes illustrating an embodiment of a cap.
Figure 12B:
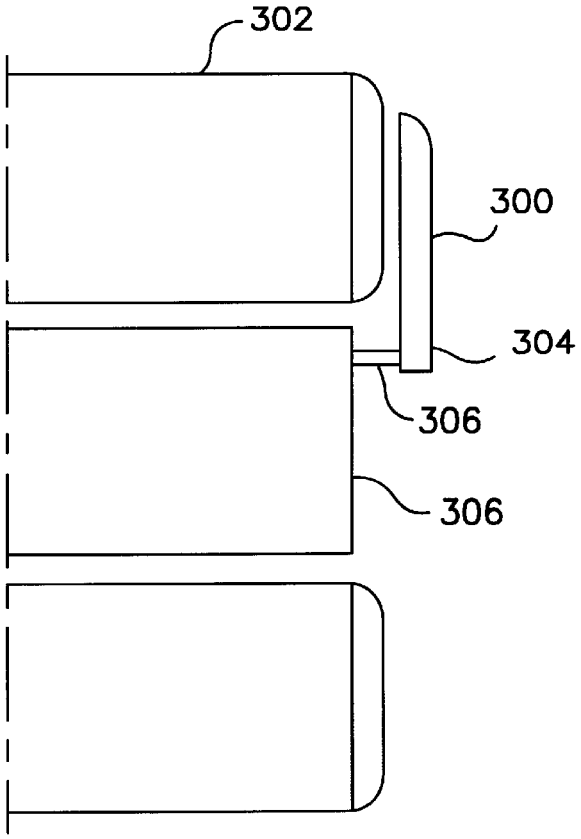

FIGS. 12*a* and 12*b* represent an end view and a side view of magazine tube showing an example of an embodiment of a cap structure that may be included at least on the end of the magazine tubes where the outfeed aperture is located. The embodiment of the cap illustrated in FIGS. 12*a* and 12*b* includes cap 300 attached to each magazine tube 302. The caps 300 are each rotatingly attached at a pivot 304. Each cap includes a circular plate with an extension at one point where the plate is mounted to the magazine tube.

In FIGS. 12*a* and 12*b*, the top and bottom caps are in a closed position. On the other hand, the center cap illustrated in FIGS. 12*a* and 12*b* has been rotated about pivot 304 to an open position. As can be seen better in FIG. 12*b*, the caps may each be connected to a shaft 306.

To open a cap of the embodiment illustrated in FIG. 12*b*, the shaft 306 may move in a direction such that the cap will be moved away from the magazine tube. The shaft and, hence, the cap may then be rotated to a position such as that charges may be loaded into or retrieved from a magazine tube. A cap typically is moved away from a magazine tube a distance sufficient for the cap to clear adjacent caps on adjacent magazine tubes. The center cap shown in FIGS. 12*a* and 12*b* is in such a position.

To close a cap, the shaft and cap may be rotated such that the cap is aligned with the magazine tube. The shaft may then move in a direction such that the cap moves toward the end of the magazine tube. Typically, the caps are able to cover the entire mouth of the magazine tubes and quite tightly seal the magazine tubes.

Each magazine tube is also accessible from the opposite end to the outfeed aperture for an ejector 43 operating in each magazine tube. These ejectors may be mechanically driven by compressed air or another medium. Of course, any suitable ejector may be utilized. Each ejector is conceived as being located inside each magazine tube.

Figure 5:
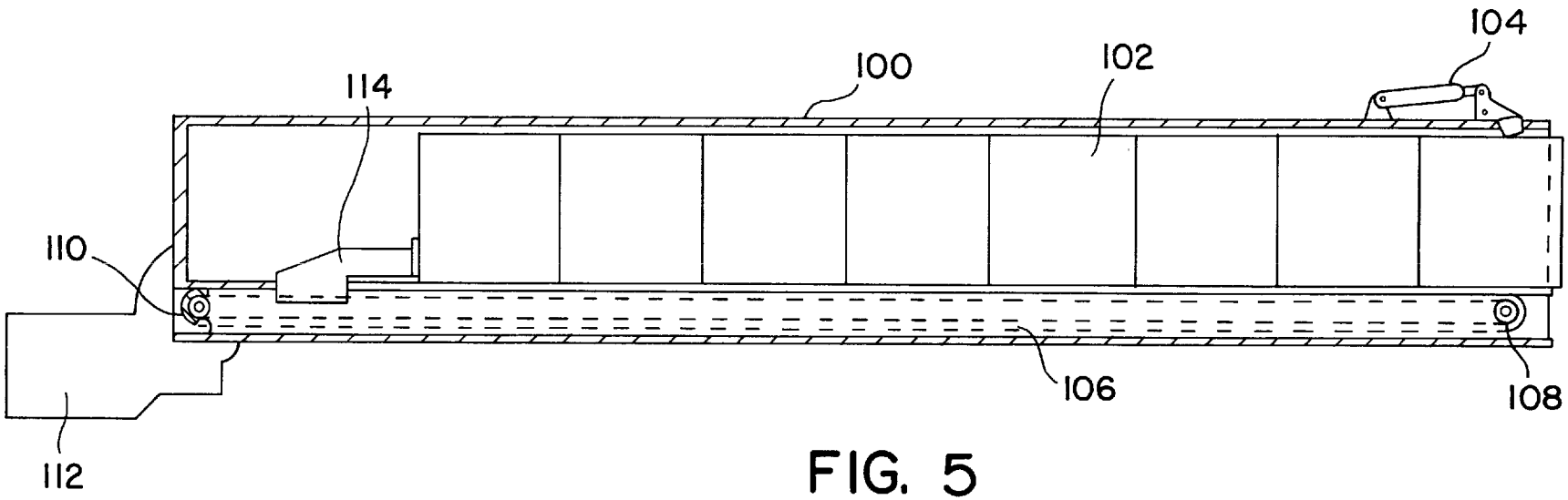
FIG. 5 shows a cross-sectional view of an embodiment of a feeding mechanism according to the present invention.

According to another embodiment, the ejectors may be chain driven. FIG. 5 illustrates an embodiment of a chain driven ejector. In particular, FIG. 5 illustrates one of the magazine tubes 100. A number of modular charges 102 have been introduced into the magazine tube 100.

An outfeed catch 104 helps to control the movement of charges out of the magazine tube. The outfeed catch can move between a position where it obstructs movement of charges out of the magazine tube and a position where it does not obstruct movement of the charges out of the magazine tube. FIG. 5 shows the outfeed catch in a position where charges are able to exit the magazine tube.

The chain driven ejector mechanism represented in FIG. 5 includes a feeding chain 106. The chain illustrated in FIG. 5 extends the length of the magazine tube. The chain 106 wraps about two sprocket wheels 108 and 110. The wheels can support and drive movement of the chain. As shown in FIG. 5, the chain, wheels, and motor may be arranged outside of the magazine tube that houses the modular charges.

The feeding chain 106 may be driven by motor 112. While any motor may be utilized, the motor in the embodiment shown in FIG. 5 is an electric motor. The motor may be interconnected with the chain to permit the motor to move the chain. The chain and the motor may be interconnected with any suitable means. In the embodiment illustrated in FIG. 5, the motor 112 drives wheel 110 through worm gearing (not shown).

As feeding chain 106 is driven by motor 112, force may be transmitted to the modular charges in a variety of ways. In the embodiment illustrated in FIG. 5, movement of the feeding chain alters the position of a feeding mechanism 114. Feeding mechanism 114 may be attached to feeding chain 106. The feeding mechanism may be attached to the chain in any suitable manner, such as by clamping about the chain and securing with bolts. The feeding mechanism includes a member that contacts and applies force to the modular charges 102. The feeding mechanism shown in FIG. 5 is arranged partially within the magazine tube and extends through the wall of the magazine tube such that it partially extends out of the magazine tube.

As the chain rotates clockwise as shown in FIG. 5 through being driven by chain 106, the chain moves the feeding mechanism to the right. Movement of feeding mechanism 114 to the right applies force to the modular charges to move them to the right. The modular charges may then exit the magazine tube and enter the retrieval tube.

The same type of propellant charge of modular type shall be stowed in each magazine tube 4. These modular charges have combustible outer casings with an external shape enabling them to be mutually combinable. Since the charges may be of different charge strengths and lengths, by assembling an appropriate combination of various such modular charges, a complete charge of exactly the strength desired can be obtained.

For retrieving modular charges from one or more predetermined magazine tubes there is a retrieval tube 6 parallel to the magazine tubes and indexable between their outfeed apertures. In the version illustrated in FIGS. 1 and 2 the retrieval tube 6 is mounted on a horizontal mechanically driveable lateral feed slide 7 which in turn is mounted on a mechanically driveable vertical feed slide 8. The latter is in turn mechanically driveable along two diagonal guides 9 and 10.

By means of the horizontal, lateral, and diagonal drives the retrieval tube 6 can access all the magazine tubes including those that are close to the sloping side roof of the armored turret. The retrieval tube 6 has one more position, namely immediately behind the loading pendulum 11 via which the artillery gun 2 is finally loaded. For transfer of the modular charges retrieved from the magazine tubes from the retrieval tube 6 to the loading pendulum there is an ejector fully integrated in the retrieval tube 6.

Each magazine tube must be equipped with an outfeed catch of some type or other to retain the modular charges in the magazine tubes when the gun is in transport mode but which can be deactivated when one or more modular charges shall be retrieved. The outfeed catches may be of elementary technical design which is why they are only generally indicated in FIG. 2 where they are designated 36.

For deactivating these outfeed catches when retrieving modular charges the retrieval tube 6 may, for example, be designed to have limited axial movement indicated by arrow 37 to enable the retrieval tube to connect snugly with the outfeed aperture of the relevant magazine tube on each occasion.

At the same time the outfeed catches 36 are designed in such a way that they automatically retract to the side of any magazine tube when the retrieval tube 6 connects with the outfeed aperture of the magazine tube in question. When retrieval is complete the outfeed catches 36 return to closed position when the retrieval tube 6 disconnects from the outfeed aperture of the magazine tube.

The retrieval tube 6 may also be fitted with an internal blocking device such as a feed stop that can be indexed between a number of different positions, each of which leaves the internal length in the retrieval tube free that corresponds to the number of modular charges that are to be retrieved on each occasion from each magazine tube. Such an indexable internal feed stop 38 (see FIG. 2) may also be used as an ejector for transferring the modular charges retrieved into the loading tray of the gun. For indexing the feed stop 38 there is an extendible/retractable hydraulic piston system 39 as illustrated in FIG. 2 comprising three slidable pistons of which two (40, 41) in the position shown in the figure are maximally extended and the third is fully retracted.

FIG. 3 shows another version providing greater maneuverability to the retrieval tube.

This version uses a compact magazine 12 consisting of parallel magazine tubes 13 arranged on top of and beside each other, all terminating in one endplane 14 where they have their outfeed apertures. All the magazine tubes are equipped with ejectors at the opposite end to the outfeed aperture. The magazine tubes shall have some kind of retaining catch at each end.

Instead of one retrieval tube this example uses four such retrieval tubes 15–18, each of which is equipped with a chain-driven ejector 19–22 as indicated in the figure. Retrieval tubes 15–18 are in turn mounted on a journal led arm 24, an elbow 25, and a wrist 26-mounted manipulator 23. By means of this manipulator 23 any of the retrieval tubes 15–18 can be positioned in front of any elective magazine tube 13 from which it can retrieve the desired number of modular charges. By repeating this sequence with all four retrieval tubes for the elective magazine tubes, four complete propellant charges can be kept in readiness.

From the position with the retrieval tubes immediately outside the outfeed apertures of the magazine tubes, the manipulator 23—thanks to its three journal led joints which, if required, can be provided with full swivel and slewing mobility—can swing the retrieval tubes directly behind the loading pendulum 27 provided for loading the artillery gun, in which position the relevant ejectors 19–22 are actuated.

Thus, with this version complete propellant charges for four rounds are always available for firing in extremely rapid sequence without the retrieval tubes needing to return to the magazine tubes for replenishment. If desired, for continuous fire only one retrieval tube needs to be replenished at a time as this would enable a more even rate of fire.

Finally, FIG. 4 shows a variant in which the propellant magazine is divided into a forward unit 29 and an aft unit 30. Both these magazines are constructed of the same sort of magazine tubes as in the previous magazine. However, they have their respective outfeed apertures 31 and 32 facing each other. As in previous versions, the ejectors are built into the magazine tubes.

In this connection it may be relevant to point out that the number of modular charges fed out from a magazine tube into a retrieval tube on each single occasion can either be determined by precisely defining the length of stroke of the ejector and the ejection velocity, or by making the outfeed ejector built into the retrieval tube adjustable according to the number of modular charges the retrieval tube shall be permitted to receive on each occasion, that is, in general as claimed in what has already been stated concerning the device shown in FIG. 2.

Figure 6A:
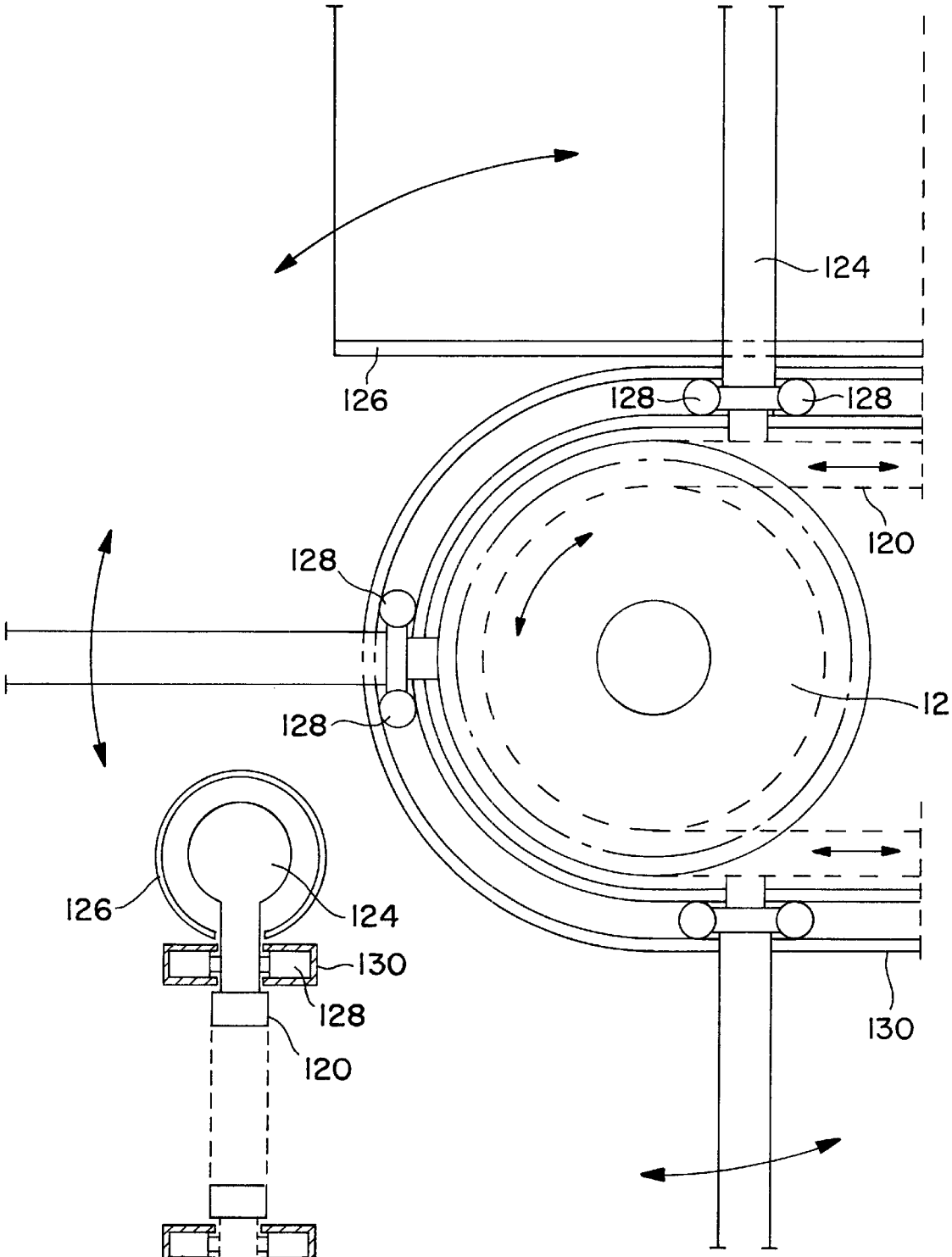
FIGS. 6*a* and 6*b* show cross-sectional views of portions of a feeding mechanism according to the present invention.
Figure 6B:
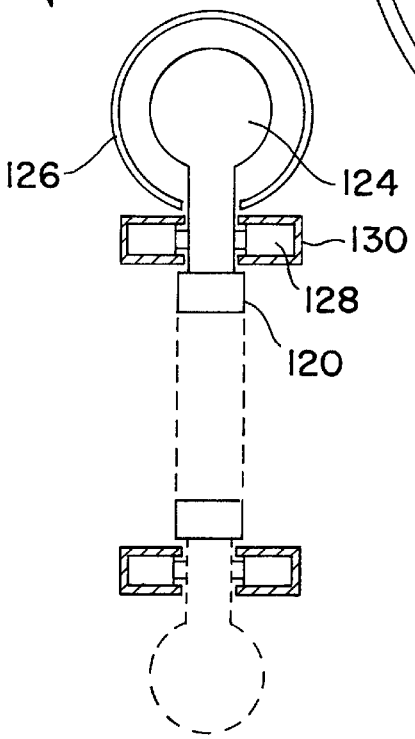

FIGS. 6*a* and 6*b* illustrate details of a portion of an embodiment of a feeding mechanism according to the present invention. The embodiment of the feeding mechanism shown in FIGS. 6*a* and 6*b* may be utilized in embodiments of the present invention that include two magazine units arranged on opposite sides of a retrieval tube, such as the embodiment illustrated in FIG. 4. As such, the ejector mechanism shown in FIGS. 6*a* and 6*b* can address the retrieval tube from either end for ejecting charges in the retrieval tube from either end of the retrieval tube.

The embodiment of the retrieval tube ejector shown in FIGS. 6*a* and 6*b* includes a feeding chain 120. As indicated by the arrow, the feeding chain may move in a counterclockwise or clockwise direction, depending upon which end of a retrieval tube it is desired to eject the modular charges from. Chain 120 is driven by a sprocket wheel 122. The sprocket wheel may turn in both counterclockwise or clockwise directions, depending upon which direction it is desired to move the feeding chain. To move the chain, the sprocket wheel may be attached to a motor (not shown).

To apply ejecting force to the modular charges within the retrieval tube, an ejector 124 may be attached to the chain. FIG. 6*a* illustrates the ejector attached to the feeding chain in three different positions. In the first position, shown in the upper portion of FIG. 6*a*, the ejector could be arranged in the retrieval tube 126 for feeding out of modular charges from the retrieval tube. Alternatively, the ejector in this position could have just finished ejecting the modular charges from the retrieval tube.

In the position illustrated at the bottom of FIG. 6*a*, the ejector could be in a position for refilling of the retrieval tube. The ejector is also illustrated at the left-hand side of FIG. 6*a* in an intermediate position between the positions at the top and bottom of FIG. 6*a*.

The ejector can be attached to the feeding chain in any suitable manner. To facilitate the movement and positioning of the ejector, the ejector could include at least one wheel 128. The ejector could include four wheels as in the embodiment illustrated in FIG. 6*a*. The wheel(s) may ride in a U-shaped rail 130. The ejector may include a double U-rail to accommodate two sets of wheels, one on either side of the ejector 124. FIG. 6*b* illustrates such an embodiment in cross-section.

The ejector shown in FIGS. 6*a* and 6*b* can permit the retrieval tube to be accessible to be loaded in an undisturbed manner with charges from either end. This ejector design can be unfolded from the retrieval tube so that the retrieval tube will be entirely free.

In the version illustrated in FIG. 4 the retrieval tube 28 is arranged to pivot between the two propellant magazines 29 and 30, and from freely elective retrieval positions can receive modular charges from each magazine both from the front and rear. Furthermore, the retrieval tube can pivot through arc 33 to a position directly behind the breech opening of the gun and thereby also function as a loading tray and rammer. Unless the retrieval tube is provided with a special angle-setting capability, however, the above can only be performed when the gun is at zero degrees elevation. Consequently, in most cases a loading pendulum 42 is required as an intermediate stage.

To enable the retrieval tube to reach all the magazine tubes as well as the correct position behind the breech opening of the gun 2 it is presupposed that the pivot arms 34 and 35, of which only 35 is visible in the figure, are of continuously adjustable length.

When replenishing magazines of the above types new modular charges are furnished by special resupply vehicles that feed in the new modular charges via purpose made hatches after which the new modular charges are distributed to the individual magazine tubes by the retrieval tube(s).

FIGS. 7–11 provide various views of an embodiment of a charge handling system according to the present invention. The charge handling system can include means for altering the position of the retrieval tube in at least two directions. The means for accomplishing the movement may include at least two rails that the retrieval tube or elements attached thereto can directly or indirectly ride on. The means for accomplishing the movement of the retrieval tube may include at least two motors.

FIGS. 1–4 illustrate various embodiments of means for altering the position of the retrieval tube(s). FIGS. 7–11 illustrate another embodiment of a system for altering the position of retrieval tube(s) of the present invention. Either system may be designed such that the loading system may operate when a gun is moving from one fire position to another fire position.

The system illustrated in FIGS. 7–11 includes two rail members 200 and 202. Each rail may permit movement in one or more directions. The embodiment illustrated in FIG. 7 includes a first guide rail 200 that permits movement of the retrieval tube in a first direction perpendicular to the longitudinal axes of the magazine tubes 198, each of which includes a catch 196.

Figure 8:
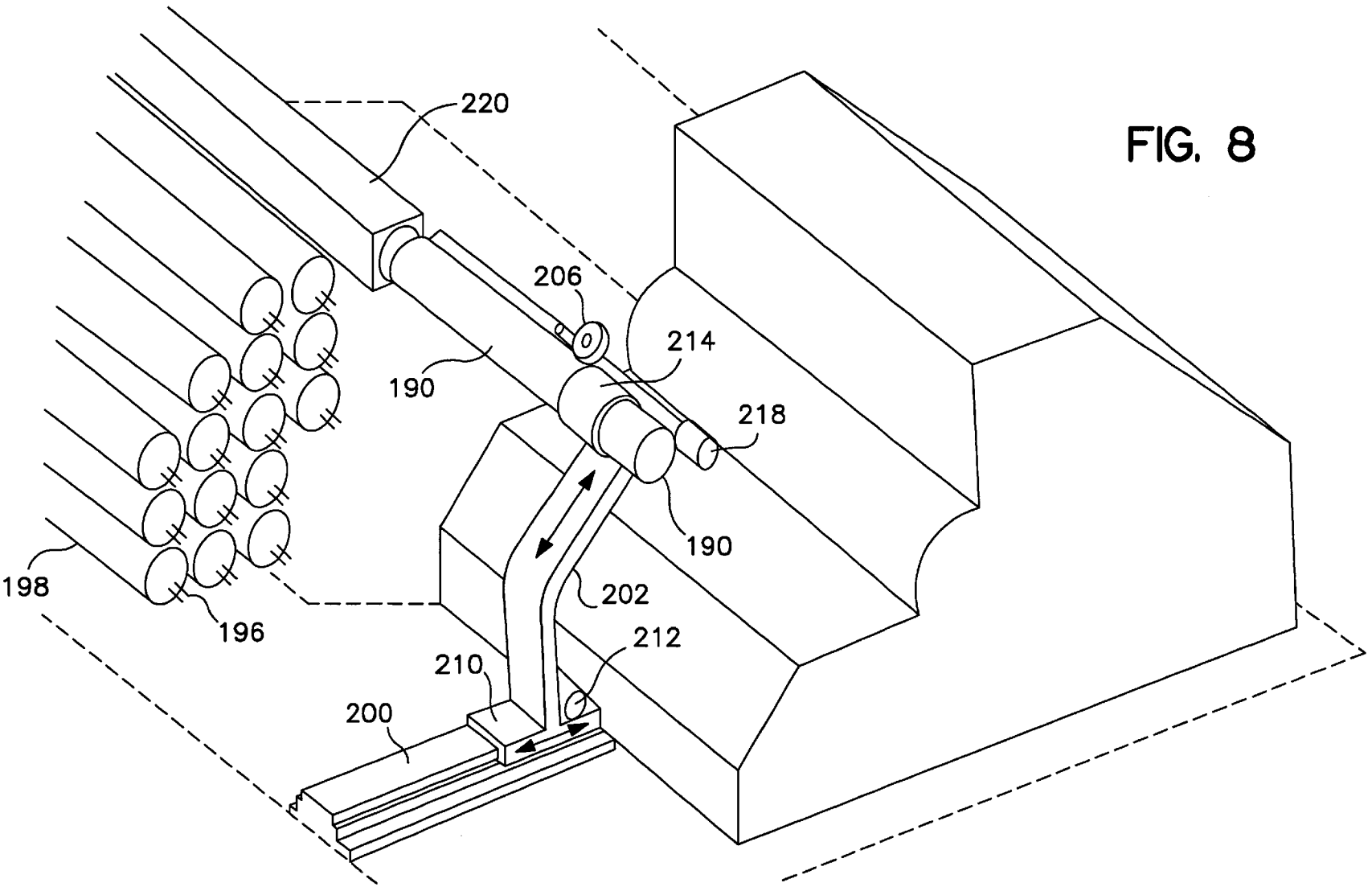
FIG. 8 shows a perspective view of a portion of an embodiment of a feeding mechanism according to the present invention.

The first and/or second rails may be beveled, bent, or include one or more sections. Along these lines, FIG. 8 illustrates an embodiment of a beveled second rail 202. The second rail 202 is beveled or bent as shown in FIGS. 7–11 to permit the retrieval tube to access all of the magazine tubes and the loading pendulum, especially where the roof of the housing is sloped.

FIG. 7 also shows a space 192 for a shell magazine.

The second rail 202 of the embodiment illustrated in FIG. 7 permits movement of the retrieval tube in a second direction and a third direction both perpendicular to the longitudinal axes of the magazine tubes. The second and third directions are different from the first direction.

Of course, the second rail may only provide for altering the position of ejector in one direction. However, as can be seen in broken lines in FIG. 7, the present invention may be housed within an armored turret 194 that has an inclined roof. Therefore, to accommodate the interior level of the turret roof, the second rail may comprise two sections 202*a* and 202*b* (the beveled rail referred to above. The two sections may be joined with a curved section 202*c* to permit the retrieval tube slide, described below in greater detail, to move along the entire length of the second rail.

To permit the retrieval tube to move along the second rail, the retrieval tube may include a retrieval tube slide. The retrieval tube slide may include wheels or other means for assisting movement of the retrieval tube slide. Alternatively or additionally, the retrieval tube slide could include a surface that slides along the second rail. The surfaces on the retrieval tube slide and the second rail could be low friction and could also include a friction reducing material, such as grease, to facilitate movement of the retrieval tube slide along the second rail. Additionally, the retrieval tube slide and/or the second rail could include means, such as a clamp, for helping to secure the retrieval tube slide in position on the second rail.

While the retrieval tube is illustrated mounted to the second rail such that about one-third of the retrieval tube is arranged on one side of the second rail and two-thirds of the retrieval tube is arranged on the other side of the second rail, the retrieval tube may be mounted such that any position with respect to the second rail. Along these lines, the retrieval tube may be mounted such that one-half of the retrieval tube is arranged on opposite sides of the second rail. Such an arrangement may be sturdier than others arrangements.

To control and facilitate movement of the retrieval tube slide along the second rail, a device according to the present invention may include a motor 206. Any suitable motor may be utilized. For example, motor 206 may be an electric motor. To move the retrieval tube slide, the motor may be connected to wheels that engage the second rail.

To permit the second rail to move along the first rail 200, the second rail may be connected to a guide rail slide 210. The guide rail slide 210 may include wheels or other means for assisting movement of the guide rail slide. Alternatively or additionally, the guide rail slide 210 could include a surface that slides along the first rail 200. The surfaces on the guide rail slide and the first rail could be low friction and could also include a friction reducing material, such as grease, to facilitate movement of the guide rail slide along the first rail. Additionally, the guide rail slide and/or the first rail could include means, such as a clamp, for helping to secure the guide rail slide in position on the first rail.

To control and facilitate movement of the guide rail slide along the first rail, a device according to the present invention may include a motor 212. Any suitable motor may be utilized. For example, motor 212 may be an electric motor. To move the guide rail slide, the motor 212 may be connected to wheels that engage the first rail.

The retrieval tube may also be moved in a direction along its longitudinal axis, perpendicular to the plane of the view in FIG. 7. Along these lines, retrieval tube 190 could be mounted on retrieval tube slide in a mount that permits the retrieval tube to move. For example, as illustrated in FIG. 8, retrieval tube 190 could be mounted within sleeve 214. A motor 216 could be utilized to drive movement of the retrieval tube in a direction parallel to the longitudinal axis of the retrieval tube.

FIG. 8 also illustrates an embodiment of an ejector for the retrieval tube. This embodiment of the retrieval tube ejector includes a motor 218. The motor 218 can drive an ejector member that applies force to modular charges within the retrieval tube to eject the charges from the retrieval tube and transfer them to a loading pendulum 220.

Figure 9:
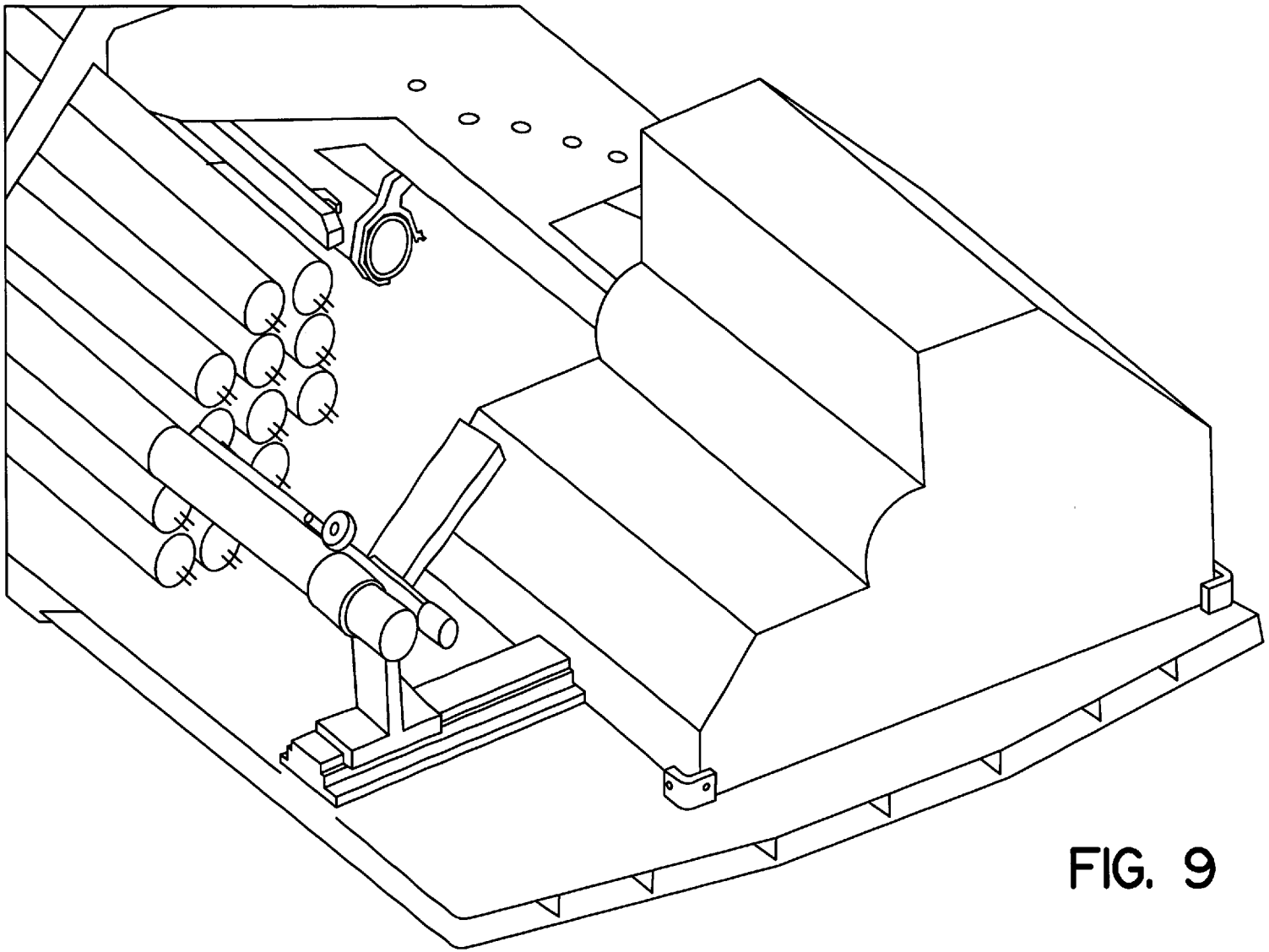
FIGS. 9, 10, and 11 show perspective views of a portion of an embodiment of a feeding mechanism according to the present invention, illustrating operation of the feeding mechanism.
Figure 10:
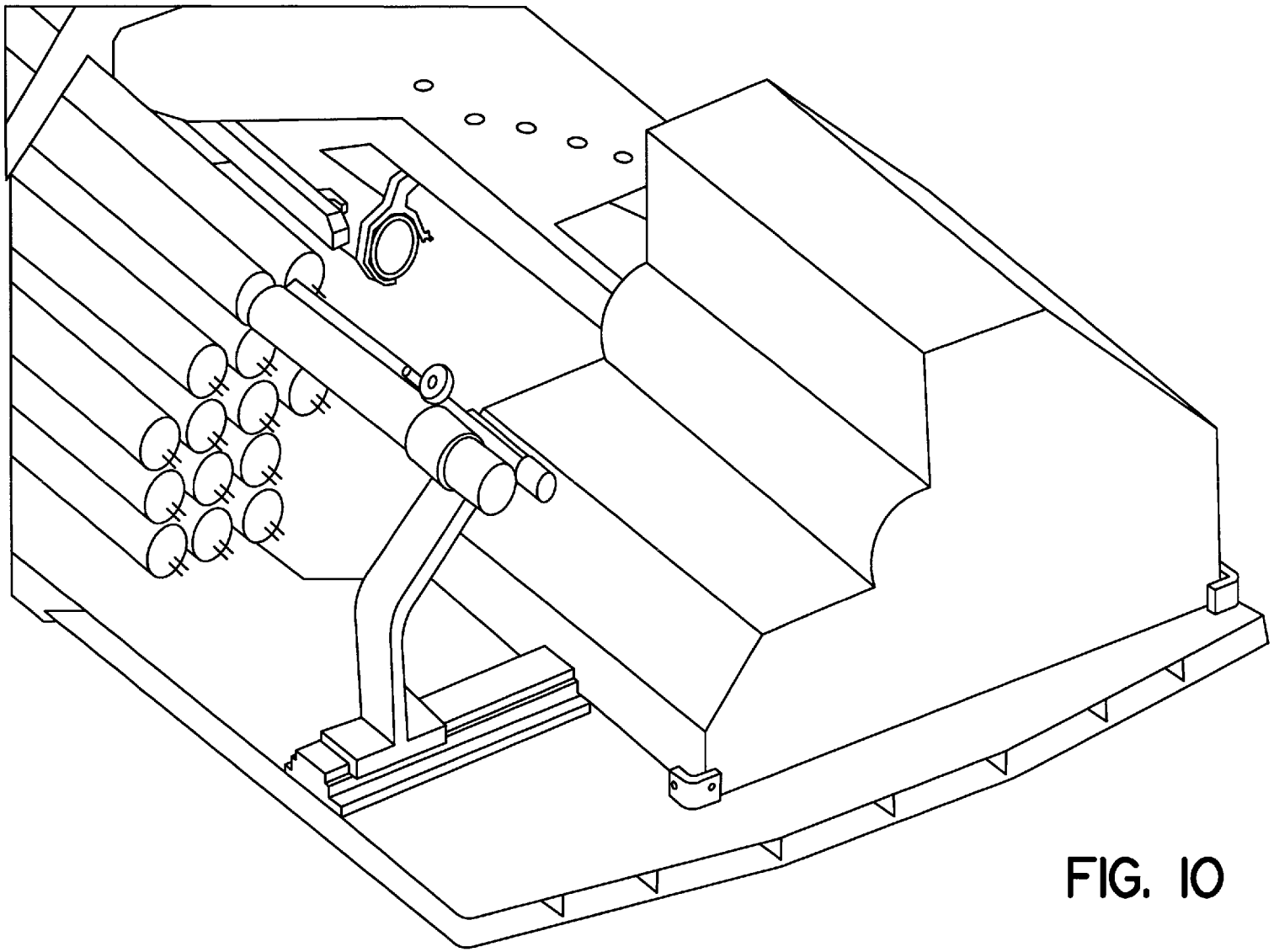
Figure 11:
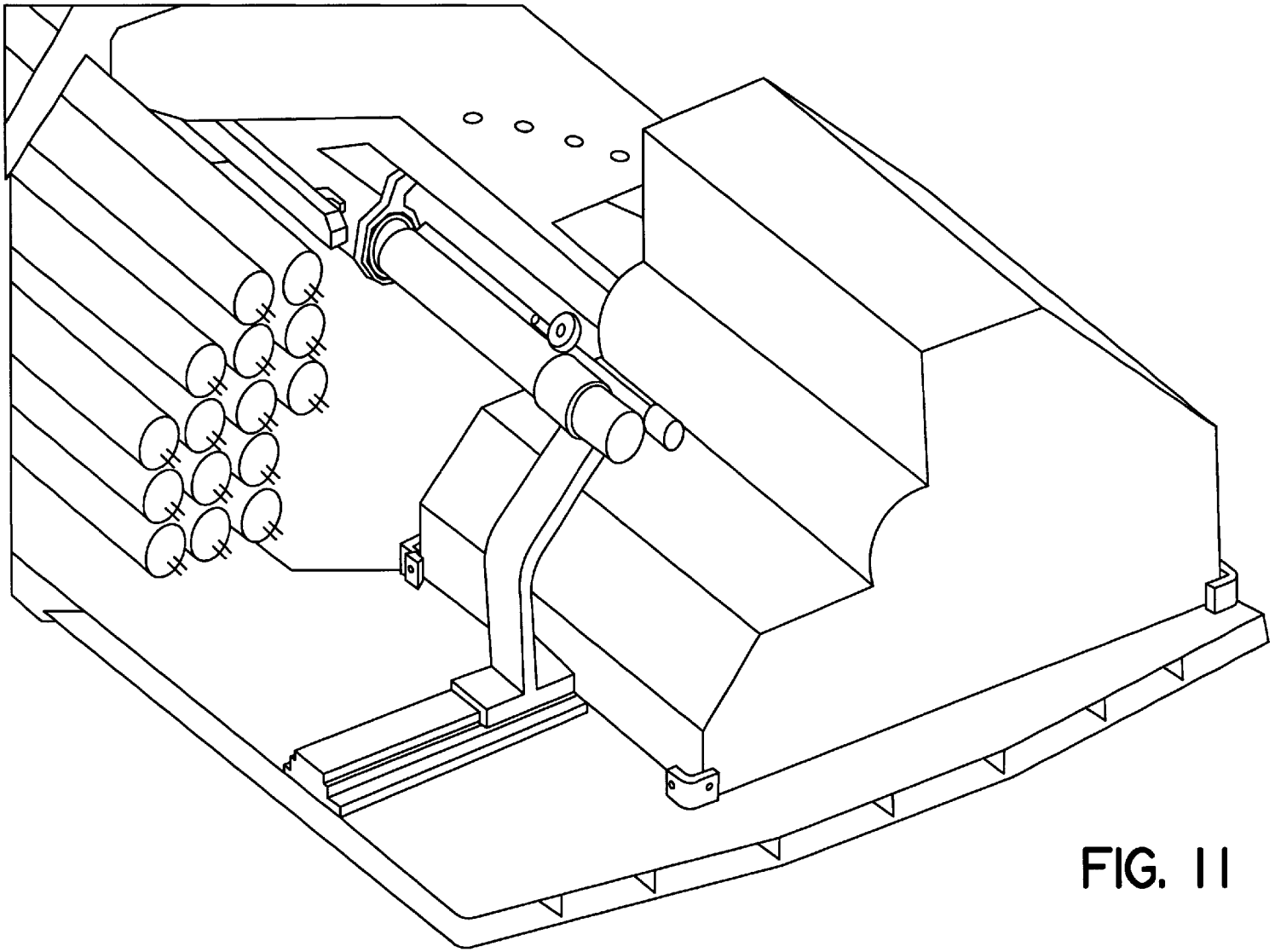

FIGS. 9–11 illustrate the embodiment shown in FIGS. 7 and 8 at various stages during the operation of the device. The retrieval tube in this embodiment includes its own index, for helping to position charges within the tube. The retrieval tube in this embodiment also includes its own feed mechanism, stop mechanism, and outfeed mechanism. However, it is not necessary that the retrieval tube include any of these index, feed, stop, or outfeed. Also, some embodiments of the retrieval tube may include some of these elements.

As can be seen in FIGS. 9–11, the two rail system permits the retrieval tube to address all of the magazine tubes as well as the loading pendulum of the gun. The rails permit the end of the retrieval tube to move in a vertical plane defining the outfeed apertures of the magazine tubes. Both guide rails may include stop positions that correspond to locations where the retrieval tube is arranged at the outfeed aperture of a magazine tube. This design permits the retrieval tube to address the magazine tubes and the loading pendulum without movement in a direction parallel to the longitudinal axis of the retrieval tube being necessary. However, movement in this direction may occur and be necessary and/or desirable.

FIG. 9 illustrates the retrieval tube aligned with one of the magazine tubes and adjacent the outfeed opening of the magazine tube. In this position, charges may be loaded from the magazine tube into the retrieval tube. In FIG. 10, the retrieval tube has been backed away from the magazine tubes and the retrieval tube slide has traveled up the second rail. In FIG. 11, the guide rail slide has been moved along the first rail, thereby moving the retrieval tube in the vicinity of the loading pendulum. Movements of the retrieval tube slide and the guide rail slide may take place sequentially and/or simultaneously. After moving the retrieval tube to a location in the vicinity of the loading pendulum, the retrieval tube may, if necessary, be moved to be sufficiently$close to the loading pendulum such that the charges may be transferred to the loading pendulum.

Movement of the retrieval tube along the second rail or movement of any other parts may be especially good by incorporating linear ball bearings in the various assemblies of the present invention.

The system illustrated in FIGS. 7–11 may more easily be made more rigid and with less dead weight. This design may also be more easier to manufacture and, thus, cheaper. Furthermore, the system shown in FIGS. 7–11 may be relatively more easily provided with electric motors close to different moving parts to provide the entire system with reliable movements for different parts.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant avt. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

I claim:

1. A device for assembling complete propellant charges from a plurality of modular propellant charges, comprising:

a plurality of magazine tubes each for receiving a plurality of modular charges, each magazine tube having an outfeed aperture;

a plurality of ejectors for ejecting the modular charges from the magazine tubes;

at least one retrieval tube for receiving the modular charges from the magazine tubes; and a manipulator for altering a position of said at least one retrieval tube adjacent any of the magazine tubes for retrieving the modular charges from among the magazine tubes, the manipulator also altering the position of the at least one retrieval tube to be adjacent a loading mechanism of an artillery gun, wherein said manipulator comprises:

a first motor for altering a position of the retrieval tube in at least one first direction; and a second motor for altering a position of the retrieval tube in at least one second direction different that the at least one first direction;

first and second rails arranged perpendicular to said magazine tubes;

a guide rail slide attached to said second rail, said guide rail slide riding on said first rail, thereby permitting said second rail to move along said first rail, said first motor driving movement of said guide rail slide; and a retrieval tube slide that the retrieval tube is attached to, said retrieval tube slide riding on said second rail, thereby permitting said retrieval tube to move along said second rail, said second motor driving movement of said retrieval tube slide rail slide.

2. The device according to claim 1, wherein the ejectors are chain driven.

3. The device according to claim 2, comprising an ejector arranged in each magazine tube.

4. The device according to claim 3, wherein each ejector comprises:

a feeding chain extending along the entire length of each magazine tube;

a feeding mechanism mounted on the feeding chain for applying force to the modular charges to eject them from the magazine tube; and a motor for driving the feeding chain, thereby altering the position of the feeding mechanism and ejecting the modular charges from the magazine tube.

5. The device according to claim 1, wherein the second motor can alter the position of the retrieval tube in two directions.

6. The device according to claim 1, wherein the second rail is beveled.

7. The device according to claim 1, wherein the second rail comprises two linear portions and a curved portion therebetween.

8. The device according to claim 1, wherein one of said rail permits movements of the retrieval tube in more than one direction.

9. The device according to claim 8, wherein the one of the rails is beveled.

10. The device according to claim 8, wherein the one of the rails comprises two linear sections and a curved section therebetween.

11. The device according to claim 1, further comprising:

an index, a feed mechanism, a feed catch, and an outfeed mechanism for handling charges within the retrieval tube.

12. The device according to claim 1, wherein all of the magazine tubes terminate in one vertical endplane and a outfeed aperture arranged in the vertical endplane.

13. A The device according to claim 1, further comprising:

an armored turret for housing at least the device.

14. The device according to claim 1, wherein the magazine tubes are parallel to each other.

15. The device according to claim 1, wherein some of the modular charges have different characteristics than other of the modular charges wherein the characteristics include at least one member selected from the group consisting of different types of propellant, lengths, diameters and strengths.

16. The device according to claim 1, wherein the modular charges are modular artillery charges.

17. The device according to claim 1, wherein the manipulator alters the position of the at least one retrieval tube in a plurality of directions.

18. The device according to claim 17, wherein the manipulator alters the position of the at least one retrieval tube in an x-direction, a y-direction, and diagonally.

19. The device according to claim 1, further comprising:

at least one retrieval tube ejector for ejecting the modular propellant charges from the at least one retrieval tube.

20. The device according to claim 1, further comprising:

a plurality of outfeed catches provided at outfeed apertures of the magazine tubes.

21. A method for assembling complete propellant charges from a plurality of modular propellant charges, the method comprising the steps of:

stowing said modular charges in a plurality of magazine tubes;

providing at least one retrieval tube;

providing a first rail for altering the position of said at least one retrieval tube in a first direction;

providing a second rail for altering the position of said at least one retrieval tube in a second direction;

providing a manipulator for altering the position of said at least one retrieval tube along said rails;

arranging said at least one retrieval tube in the vicinity of an outfeed aperture of at least one of said magazine tubes;

moving a plurality of said magazine tubes into said at least one retrieval tube;

arranging said at least one retrieval tube in the vicinity of a loading mechanism of an artillery gun; and transferring said modular charges from said at least one retrieval tube to said loading mechanism.

22. The method according to claim 21, wherein the modular charges are moved from the magazine tubes with a chain drive.

23. The method according to claim 21, wherein arranging the at least one retrieval tube in the vicinity of an outfeed aperture of at least one of the magazine tubes comprises altering a position of the retrieval tube in at least two different directions.

24. The method according to claim 21, wherein the retrieval tube is connected to a retrieval tube slide and the position of the retrieval tube is altered in the at least one second direction by moving the retrieval tube slide along the second rail and wherein the second rail is connected to a guide rail slide and the position of the second rail in the first direction by moving the guide rail slide along the first rail.

25. The method according to claim 24, wherein the position of the retrieval tube is altered in two directions at angles to each other along the second rail.

26. The method according to claim 24, wherein the position of the retrieval tube is altered by two motors.

27. The method according to claim 21, wherein assembling the propellant charges from a plurality of modular charges having different characteristics than other of the modular charges wherein the characteristics include at least one member selected from the group consisting of different types of propellant, lengths, diameters and strengths.

28. The method according to claim 21, wherein the position of the at least one retrieval tube may be altered in a plurality of directions with the manipulator.

* * * * *